United States Patent [19]

Roberto et al.

[11] 4,386,714

[45] Jun. 7, 1983

[54] CONTAINER COVER ASSEMBLY

[76] Inventors: Louise Roberto, 864 Rockland Ave.; Stephen Casale, 70 Sommer Ave., both of Staten Island, N.Y. 10314

[21] Appl. No.: 348,699

[22] Filed: Feb. 16, 1982

Related U.S. Application Data

[63] Continuation-in-part of Ser. No. 193,204, Oct. 2, 1980, abandoned.

[51] Int. Cl.[3] ..... B65D 43/14; B65D 51/04

[52] U.S. Cl. ..... 220/339; 220/306; 220/335; 215/235; 222/517

[58] Field of Search ..... 215/235; 220/335, 306, 220/339; 222/517

[56] References Cited

U.S. PATENT DOCUMENTS 4,082,201 4/1978 Bittel ..... 220/339

FOREIGN PATENT DOCUMENTS 2355818 5/1975 Fed. Rep. of Germany ..... 215/235

*Primary Examiner*—George T. Hall

*Attorney, Agent, or Firm*—Howard I. Podell

[57] ABSTRACT

A snap cover hinged to the neck of a collapsible tube such as a tube of toothpaste. The cover is hinged by a plurality of hinge members located to apply spring bias to the cover in both the open and closed positions of the cover so as to maintain the cover in the manually set position. A sleeve collar projects from the top inside face of the cover of a size to fit about the neck of the tube in the closed position so as to restrain contents of the tube from spreading along the inside face of the cover beyond the sleeve.

5 Claims, 12 Drawing Figures

CONTAINER COVER ASSEMBLY

This application is a continuation-in-part of pending application No. 193,204, filed Oct. 2, 1980 by the same inventors, which application is herewith abandoned.

SUMMARY OF THE INVENTION

Our invention is a snap cover mounted on a collapsible tube such as a dispenser of toothpaste which is mounted by two sets of hinge members to the neck of the tube so as to seal the mouth of the tube opening in the closed position and to maintain the tube opening in the open position of the cover.

A first set of hinge members is formed of two short members that remain in relatively constant length during the rotation of their common hinge axis. The other set of hinge members consists of an angle section formed of two joined legs of resilient material hinged at their opposed ends to the cover and the neck respectively, with the legs of the angle section stretching in length or rotating about their common juncture, or both, as the angle section is pivoted from the open to the closed position of the cover so that the angle section maintains spring bias to maintain the cover sealed relation with the neck opening in the closed position of the cover or to bias the cover in an open position after the cover has been pivoted to the open position.

The cover is formed with a shaped collar section of a size to fit about the neck of the tube in the closed position, with the collar section projecting from the inside top face of the cover, so that paste in the tube cannot spread about the inside face of the cover beyond the collar if the collapsible tube is inadvertently squeezed in the closed position of the collar. Consequently, when the cover is pivoted to the open position, and the mouth of the tube pointed downwards from ejecting some of the tube contents onto a toothbrush, any toothpaste on the inside face of the cover is retrained from flowing by the collar, such that upon closure of the cover, no such toothpaste is extruded beyond the sealing surfaces of the cover.

Preferably, the cover collar is formed with an inside surface of a curved convex shape in cross-section and the external surface of the neck is formed of a curved concave shape of a slightly greater radius of curvature than that of the convex surface of the collar. The top rim of the neck is in the form of a thin flexible projecting annular flange that maintains an interference fit with the convex surface of the collar so as to wipe the inner surface of the collar and to force any contents of the tube about the mouth of the neck back into the tube when the cover is hinged to the closed position.

BACKGROUND OF THE INVENTION:

Collapsible paste dispensers have traditionally been fitted with threaded caps or with snap caps and some such containers have been fitted with captive means to retain the cap in the open position. Such devices are described in U.S. Pat. Nos. 2,921,716; 3,404,816; 3,369,720; and in Canadian Pat. Nos. 552,797; 615,280; and 472,739.

A liquid container is presently marketed with spring-biased hinges as shown in FIG. 6, and fitted with a detent that projects from the inner face of the cover so as to project inside and engage the walls of the opening of the neck of the container cover.

However, as described herein, there is no suggestion of combining in a collapsible container, a cover mounted by springbias hinges to the neck of the container, with the cover fitted with means to prevent spread of the contents of the dispenser about the inside face of the cover so as to prevent such contents from spilling from the cover when the dispenser is inverted, as in applying toothpaste from such a dispenser to a toothbrush, nor is there any suggestion of a shape or cover and of tube neck which provides the means of wiping contents of the tube from the surface of the cover.

BRIEF DESCRIPTION OF THE DRAWINGS:

The objects and features of the invention may be understood with reference to the following detailed description of an illustrative embodiment of the invention, taken together with the accompanying drawings in which.

Figure 6:
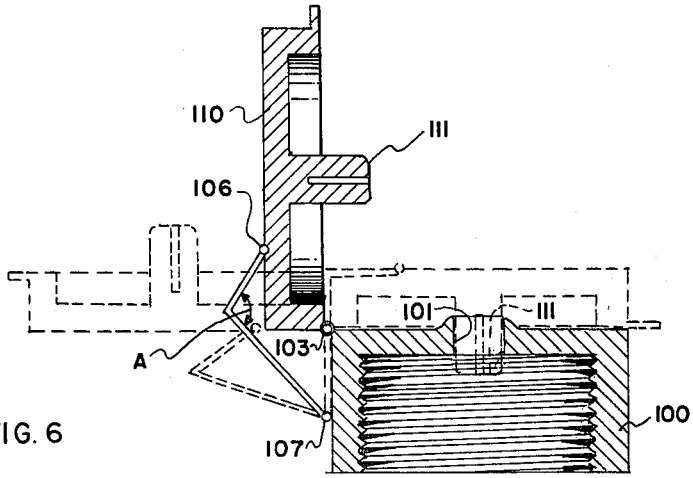
FIG. 6 is a sectional view of the prior art device.

DESCRIPTION OF THE PREFERRED EMBODIMENT:

FIG. 6 illustrates a hinged cover cap assembly of the prior art adaptable for a liquid dispenser. Cap 100 is fitted with a screw thread for attachment to a bottle of a liquid. Cover 110 is fitted with a hollow peg 111 that projects from the inside face of cover 110 for plugging an opening 101 in the cap 100 in the closed position. Cover 110 is mounted by first hinge 103 to the upper part of cap 100 and by an angle member 105 hinged to the cover and to the cap at pivot points 106 and 107 respectively. The angle A of the angle member 105 expands at the mid-point of pivoting the cover from the open to the closed position or back, with the angle member applying spring bias to maintain the cover in the open or closed position based on the elasticity of the angle member to return to its original size and shape. Sealing action of the prior art cover is dependent upon manual action to push the cover to the fully closed position after the peg 111 snugly engages the walls of opening 101 of the cap.

Figure 1:
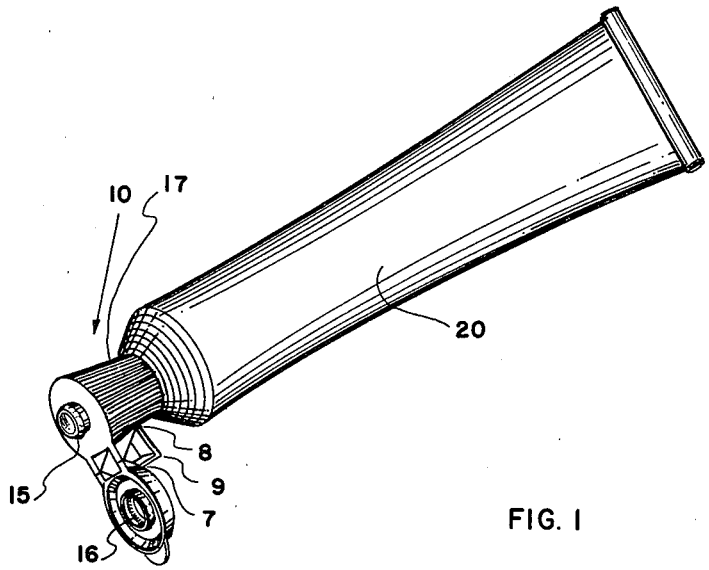
FIG. 1 is a perspective view of the invention in use.
Figure 2:
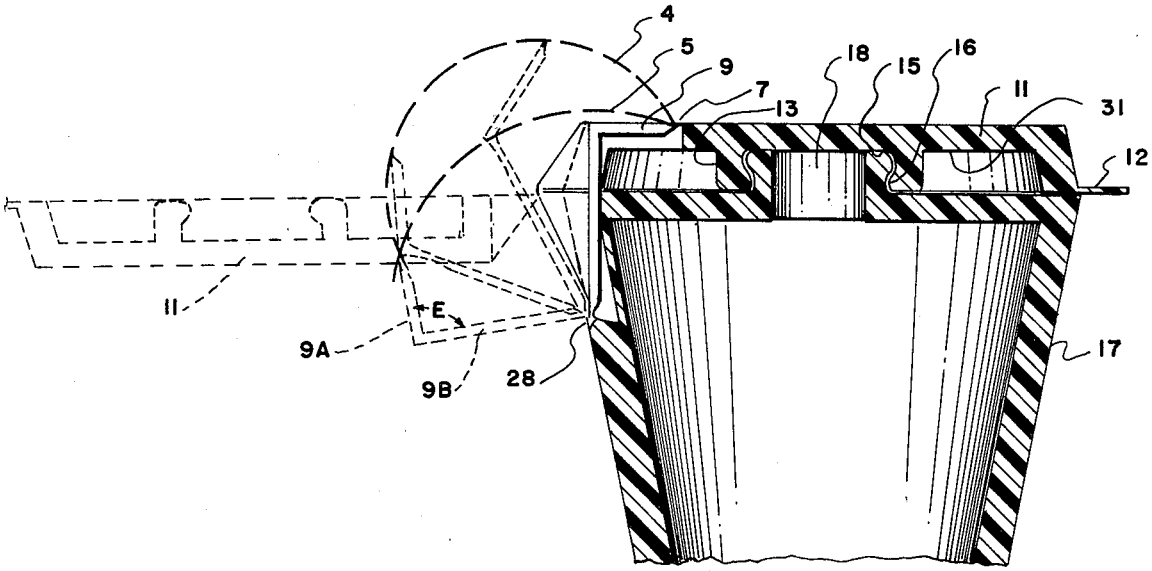
FIG. 2 is a sectional view of the invention taken along line II—II of FIG. 4.
Figure 3:
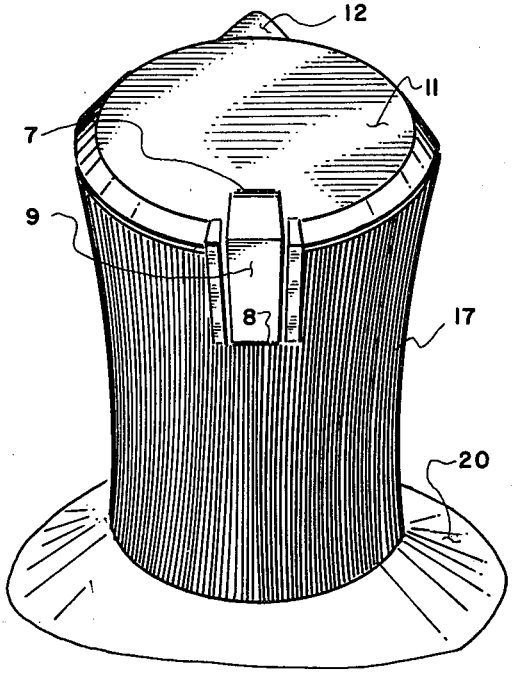
FIG. 3 is a perspective view of the invention.
Figure 4:
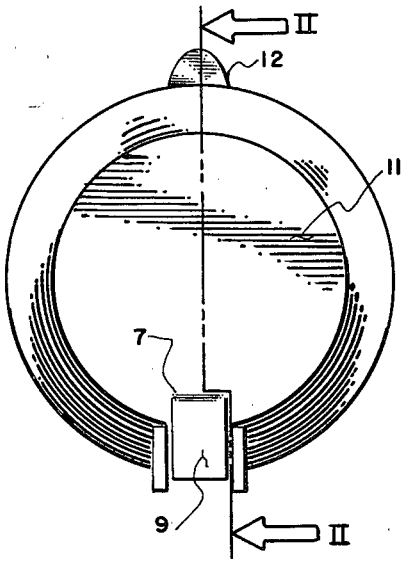
FIG. 4 is a plan view of the invention.
Figure 5:
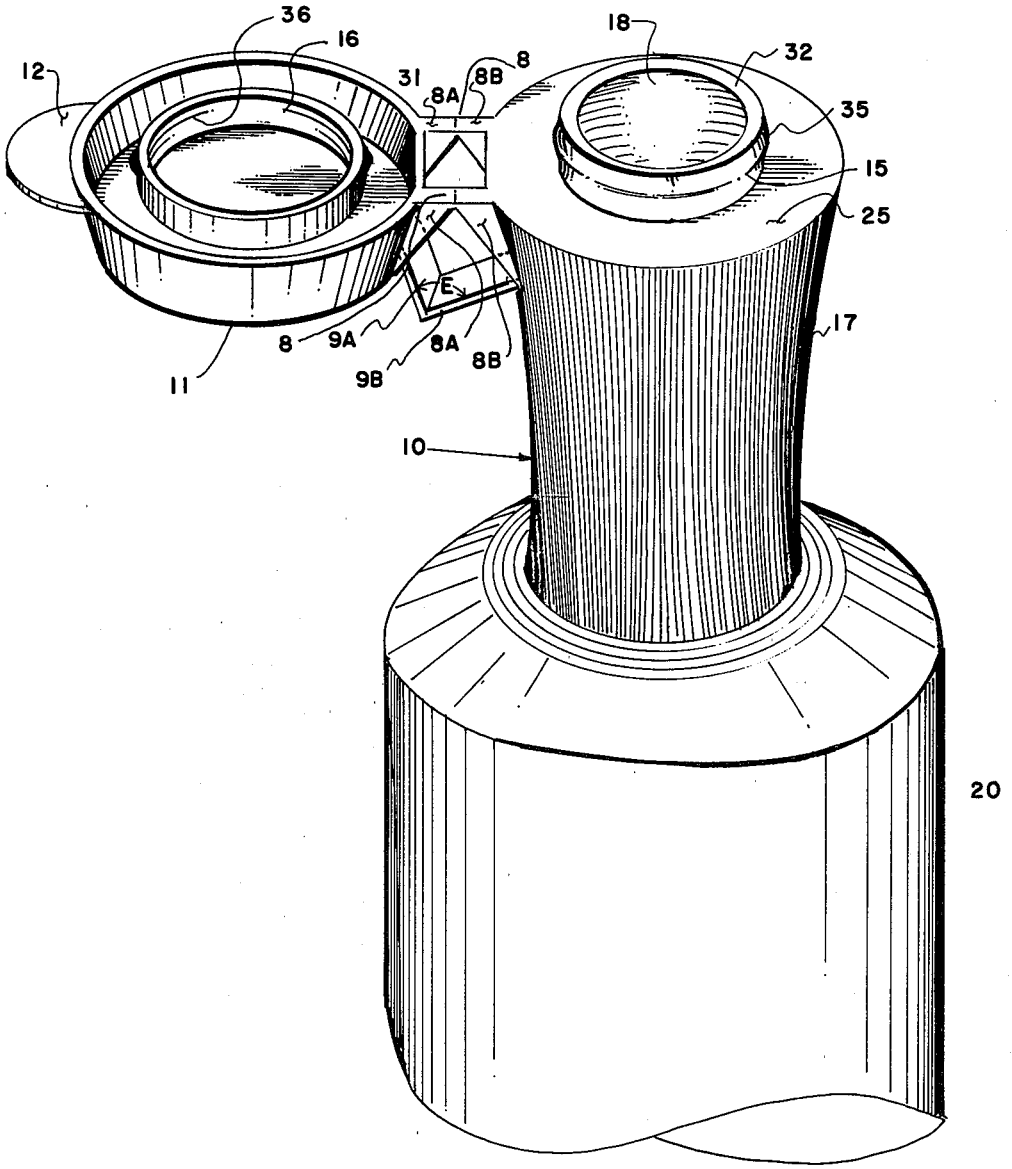
FIG. 5 is a perspective view of the invention.
Figure 7:
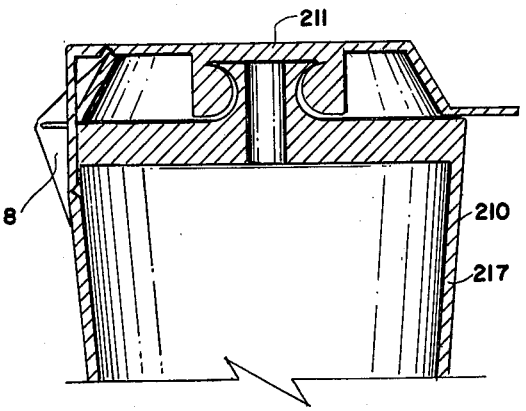
FIG. 7 illustrates a sectional view of an alternative embodiment of the cover collar and tube neck of the invention.

As shown in FIGS. 1, 2 and 5, the invention of the applicant is a cover assembly 10 of semi-flexible plastic material fastened about the neck of a collapsible container 20, such as a toothpaste container. Cover assembly 10 includes neck section 17 which is fastened to container 20 and cap section 11.

A central mouth opening 18 in neck section 17 is bounded by an upraised sleeve section 15 that extends from an annular flange 25 that forms an external end face of neck section 17.

Cap 11 is joined to a neck section 17 by a two spaced first hinge sets 8 of hinge members 8A, 8B, with members 8A fixed to the cap and members 8B fixed to the neck section and each member 8A pivotally joined to a respective section 8B by a pivot section 8C of reduced cross-sections. Except at pivot section 8C, these hinge members are relatively short and inflexible. A second set 9 of hinge members consists of an angle section formed of leg members 9A and 9B oriented at an angle E to each other and located between the sets 8 of hinges. Leg 9A is pivotally joined by a reduced section 7 to cap 11 and leg 9B is similarly joined at 28 to neck section 17, with legs 9A and 9B joined at angle E to form a right angle in the relaxed position.

Projection 12 extends from cap 11 to serve as a manual grip.

The hinge arrangement of the cover assembly of the prior art shown in FIG. 6 and the hinge arrangement of the assembly 10 of the invention function in a similar manner to apply spring bias to maintenance of the cap in the fully open or fully closed position. As shown in FIG. 2, the cap rotates about the axis of hinges 8, with the reduced section 7 consequently rotating along arc 4. However, to maintain angle E as a right angle, section 7 would have to rotate about arc 5 centered at the axis of reduced section 28. Consequently the set 9 of hinge members are elastically deformed to result in an increase in the amount of angle E or an increase in length of legs 9A and 9B or both during rotation between the open and closed positions of the cap.

A sleeve 16 in the form of a collar extends from the inner face of cap 11 and is of a size to fit about sleeve section 15 of the cover as the cap is rotated into the closed position. Preferably sleeve 16 is formed with an internal lip 36 that engages and rides past an external lip 35 on sleeve section 15 as the cap is closed so as to provide a deformable interference fit between lips 35 and 36 just short of the closed position. Lips 35 and 36 do not necessarily engage each other in the final closed position, with the shape and size of the hinge set 9 such as to provide additional spring bias to force the inner flat face 31 of cap 11 that lies within sleeve 16 into sealing engagement with the flat face of top rim 32 of sleeve 16. Consequently, in the closed position of the cap 11, the container is positively sealed by the action of the spring bias of the hinges. Should the collapsible container 20 be inadvertently compressed in the closed position of the cap so as to counter the spring bias of the hinges, and to tend to open the cap, the cap would rotate only to the point of interference between internal lip 36 and external lip 35.

Thus the closed cap can furnish an air-tight seal during the lifetime of use of the container since the seal is effected by hinge spring bias forcing the inner face 31 of the cap against exterior face 32 of the cover, with an absence of wear such as occurs by abrasion of surfaces that snugly slide past each other or engage in interference fits to provide the latch engagement of lips 35, 36.

The cover assembly is preferably molded of an elastic-deformable resilient plastic material and is molded in the open position of the cap.

As shown in FIGS. 7, and 8*a*–8*f*, the alternative embodiment is a cover assembly 210 of semi-flexible plastic material fastened about the neck of a collapsible container 20, such as a toothpaste container. Cover assembly 210 includes neck section 217 which is fastened to container 20 and cap section 211.

A central mouth opening 218 in neck section 217 is bounded by an upraised sleeve section 215 that extends from an annular flange 225 that forms an external end face of the neck section 217.

Cap 211 is joined to a neck section 217 by a two spaced first hinge sets 8, and by the second set 9 of hinge members, as shown in FIG. 5.

Projection 12 extends from cap 211 to serve as a manual grip.

The hinge arrangement of the cover assembly 210 function to apply spring bias to maintenance of the cap in the fully open or fully closed position.

A sleeve 216 in the form of a collar extends from the inner face of cap 211 and is of a size to fit about sleeve section 215 of the cover as the cap is rotated into the closed position. Sleeve 216 is formed with an internal surface 260 that is shaped as a convex curve, in cross-section, with the external surface 270 of neck section 217 shaped, in cross-section as a concave curve, preferably of a radius of curvature slightly greater than the radius of curvature of the convex curve of the cross-section of surface 260. The tip rim 232 of sleeve section 215 is flat and in a horizontal plane perpendicular to the vertical axis of mouth opening 218 in the upright position of the assembly as illustrated. Rim 232 extends outwardly as a projecting annular flange 233 which snugly nests inside of an annular slot 235 in the cap unit 211 so as to be held as a latch in the closed position of cap 211. The spring bias of the hinge assembly forces the inside flat surface 236 of the cap against flat top rim 232 to seal the cover assembly in the closed position.

The cover assembly 217 is molded of a semi-flexible plastic material to enable the cap section 211 to bend as it is rotated about the hinge axis into or out of the closed position by manual pressure applied to the projection 12.

Figure 8A:
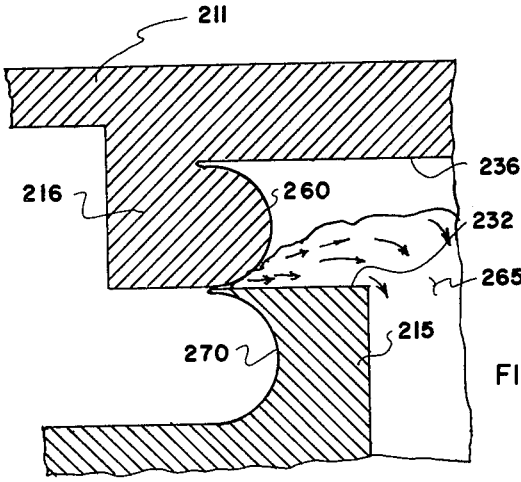
FIGS. 8*a*–8*f* illustrate sequential sectional views of the cover collar engaging the neck of the tube, of the alternative embodiment.
Figure 8B:
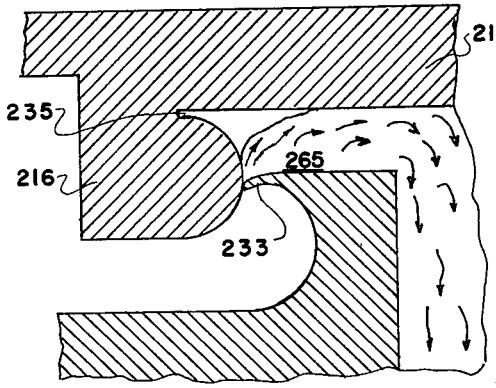
Figure 8C:
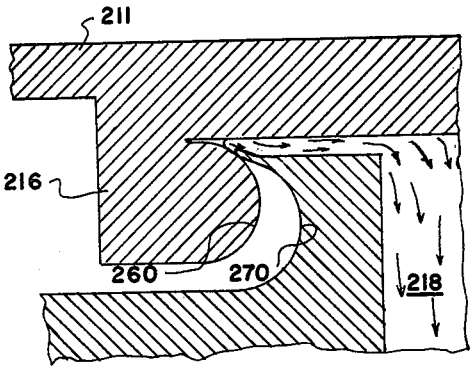

As shown in FIGS. 8*a*–8*c*, the rim 232 projecting from the flange of sleeve section 215 wipes against the convex internal surface 260 of cap section 211 as the cap section is rotated into the closed position to force any paste contents such as toothpaste 265 projecting beyond sleeve mouth opening 218 back into opening 218 and into the interior of the container in which cover unit 210 is fixed. The latching action of rim 232 engaged in annular slot serves to also form a seal so as to prevent any exposed contents 265 from drying out in or around mouth opening 218, when the cap section is in the closed mode shown in FIGS. 7 or 8*d*.

Figure 8D:
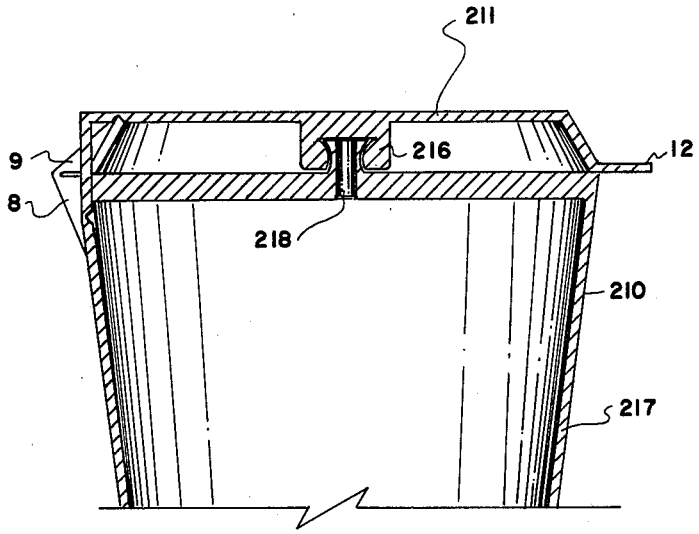
Figure 8E:
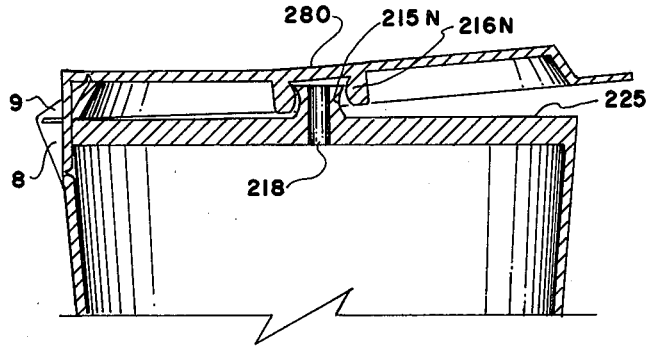
Figure 8F:
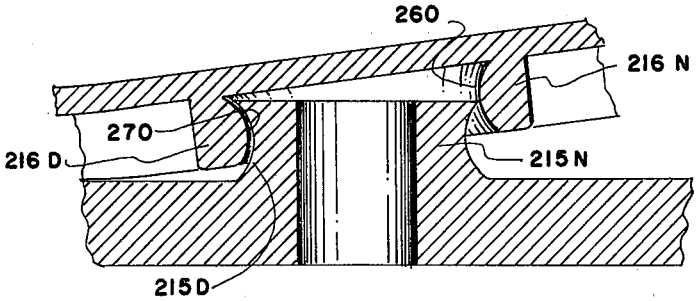

The engaging convex curved cap surface 260 and concave curved sleeve surface are readily separated when the cover is to be manually opened, as shown in FIGS. 8*d*–8*f*.

Upward opening torque applied to projection 12 causes the cap section to bend about the center 280 of the cap section so as to rotate the portion 216N of the cover sleeve 216 nearer to projection 12 away from engagement with neck sleeve section 215N. After this section 216N of cover sleeve 216 has been lifted beyond engagement with the neck sleeve section 215, the opposite cover sleeve sections 216D slides against neck sleeve section 215D with the radius of curvature of the surfaces of sections 216D and 215D lying in the direction of the axis of hinge 8. The flexibility of the material of the assembly enables the sleeve sections to flex to accomodate the slipping into or out of engagement.

The degree of torque required against projection 12 is a function of the flexibility of the material of the assembly and the actual dimension selected. Thus the minimum torque opening required can be designed so as to be greater than that likely to be provided by a child to prevent the closed cover from being opened by a child.

Since obvious changes may be made in the specific embodiment of the invention described herein, such modifications being within the spirit and scope of the invention claimed, it is indicated that all matter container herein is intended as illustrative and not as limiting in scope.

Having thus described the invention, what I claim as new and desire to secure by Letters Patent of the United States is:

1. A cover assembly adaptable for fastening to a container formed of flexible plastic material, comprising a hollow neck section that may be fitted to the mouth of a container, a cap section pivotally mounted to the neck section by resilient hinge means, said hinge means shaped and located so as to be elastically deformed and to provide a spring bias so as to alternatively maintain the cap section in either a fully open position or a fully closed position, said cap section formed with an internal flat surface, said neck section formed with an annular flange bounding a central opening at the exterior end of the neck section, with said opening communicating to the hollow interior of the neck section and the mouth of a container to which the neck section may be joined, said annular flange formed with an external flat surface that engages, in sealing relation, the internal surface of the cap in the fully closed position of the cap to the neck section so as to seal the central opening of the neck section in the fully closed position of the cap section to the neck section, together with elastic means to maintain the cap normally in the fully closed position, in which a first upraised neck sleeve section extends from the flange of the neck section to bound the neck central opening, and in which a second upraised cover sleeve section extends from the internal surface of the cap section, said second cover sleeve section formed with a blind central opening bounded by an interior wall of a shape and size to fit about the first neck sleeve section, in the closed position of the cap, where said first neck sleeve section terminates in an annular flange that forms a projecting rim of a greater diameter than the minimum diameter of the central opening of the second cover sleeve section, and said second cover sleeve section is formed with an annular slot concentric to and communicating with said central opening, said slot of a diameter at least that of the said annular flange of the neck sleeve section, with said slot located substantially at the junction of the second cover sleeve section and the internal surface of the cap section, such that said annular flange serves to both wipe against the surface of the interior wall of the cover sleeve section during closure of the cap section to the cover section so as to wipe any extruded contents of a container to which the assembly is fastened and to force such wiped contents back into the container through the neck central opening and to latch the cap section to the neck section when the annular flange of the cover section is engaged on the annular slot of the cap section.

2. The invention as recited in claim 1 in which the circular interior wall of the blind central opening of the cap section is of a convex shape in cross-section and the circular exterior wall of the neck sleeve section is of a concave shape in cross-section with both wall sections of a size and shape to mutually engage each other in the closed mode.

3. The invention as recited in claim 2 in which the radius of curvature of the arc of the convex surface is slightly less than the radius of curvature of the arc of the concave section.

4. The invention as recited in claim 2 in which a projection extends from the cap section opposite the location of the hinge means and the cap section is formed of a size and shape so as to flex about the center of the cap where torque in the opening direction is applied to the projection in the closed position of the assembly so as to enable one portion of the cap section sleeve to be slid free of engagement with the engaged position of the neck section sleeve.

5. The invention as recited in claim 3 in which the cap section is formed of a size and shape to require a minimum opening torque from the closed position that is greater than accepted standards of the torque that a young child may apply, so as to make said cover assembly unopenable by such a young child.

* * * * *